United States Patent [19]

Grange et al.

[11] Patent Number: 4,869,077

[45] Date of Patent: Sep. 26, 1989

[54] OPEN-CYCLE COOLING APPARATUS

[75] Inventors: John A. Grange, Brooklyn, N.Y.; Walter Tuzel, Newport News, Va.

[73] Assignee: Hypres, Inc., Elmsford, N.Y.

[21] Appl. No.: 88,400

[22] Filed: Aug. 21, 1987

[51] Int. Cl.[4] ..... F25B 19/00

[52] U.S. Cl. ..... 62/51.1; 62/50.1; 250/352; 285/47; 285/904

[58] Field of Search ..... 62/55, 514 R, 514 JT; 285/47, DIG. 5; 250/352

[56] References Cited

U.S. PATENT DOCUMENTS

| | | | |
|---|---|---|---|
| 1,769,087 | 7/1930 | Vucassovich | 62/64 |
| 2,261,808 | 11/1941 | Morris | 99/195 |
| 2,470,245 | 5/1949 | Green | 49/89 |
| 2,988,898 | 6/1961 | Hesson et al. | 62/168 |
| 3,079,504 | 2/1963 | Hutchens | 250/83 |
| 3,083,547 | 4/1963 | Stevens et al. | 62/374 |
| 3,257,823 | 6/1966 | Hogan | 62/514 JT |
| 3,431,749 | 3/1969 | Bounds et al. | 62/293 |
| 3,548,607 | 12/1970 | Pillsbury, Jr. et al. | 62/55 |
| 3,626,717 | 12/1971 | Lorch | 62/55 |
| 3,696,627 | 10/1972 | Longsworth | 62/51 |
| 3,706,208 | 12/1972 | Kadi et al. | 62/55 |
| 3,894,403 | 7/1975 | Longsworth | 62/55 |
| 3,978,686 | 9/1976 | Lechner et al. | 62/514 R |
| 3,991,587 | 11/1976 | Laskaris | 62/55 |
| 4,190,106 | 2/1980 | Dunmire et al. | 165/185 |
| 4,228,662 | 10/1980 | Klipping | 62/514 R |
| 4,450,693 | 5/1984 | Green et al. | 62/514 R |
| 4,459,823 | 7/1984 | Josephs et al. | 62/268 |
| 4,488,406 | 12/1984 | Eckels | 62/55 |
| 4,498,046 | 2/1985 | Faris et al. | 324/158 F |

OTHER PUBLICATIONS

Air Products & Chemicals, Inc., "Model LT-3-110 Liquid Transfer Heli-Tran Refrigerators-Operating Manual".

Air Products & Chemicals, Inc., "Models LT-3-110 and LT-3B-110 Heli-Tran Liquid Transfer Refrigeration Systems", Technical Manual, Sep. 1984.

Siefert, H., "Liquid Helium Cooled Sample Stage for Scanning Electron Microscope", Jul. 15, 1982.

Moskowitz, P. A., et al., "Cryosampler Interface", IBM Research Report, RC 9614 (#42408), 10/1/82.

Moskowitz, P. A., et al., "Superconducting Electronics Testing," IBM Research Report, RC 9519 (#42090), 8/18/82.

*Primary Examiner*—Ronald C. Capossela

*Attorney, Agent, or Firm*—Kenyon & Kenyon

[57] ABSTRACT

An improved open-cycle cooling apparatus in which a cooling chamber holding a device to be cooled is coupled with a cold fluid delivery system and, in which the cold fluid delivery system includes a delivery tube which directs a stream of cold fluid to strike the device and a return which vents the expended cold fluid from the cooling chamber. The improvement comprises a rigid enclosure formed within the chamber and configured to adaptively engage one end of the cold fluid delivery tube. The device to be cooled is disposed within the enclosure. The enclosure also includes a return to remove expended cold fluid from the cooling chamber to the return of the cold fluid delivery stystem. The improvement further comprises an alignment guide disposed within the enclosure between the device to be cooled and the one end of the cold fluid delivery tube engaged to the enclosure. The guide is configured to adaptively receive the one end of the cold fluid delivery tube and is disposed to accurately align the stream of cold fluid from the cold fluid delivery tube with the device to be cooled. The guide also permits the cooling chamber to rotate relative to the cold fluid delivery tube to compensate for any angular or twisting motion by the delivery tube.

10 Claims, 2 Drawing Sheets

OPEN-CYCLE COOLING APPARATUS

TECHNICAL FIELD OF THE INVENTION

The invention relates to an improved open-cycle cooling apparatus in which a cooling chamber holding a device to be cooled is coupled with a cold fluid delivery system and, in which the cold fluid delivery system includes a delivery tube which directs a stream of cold fluid to strike the device and a return which vents the expended cold fluid from the cooling chamber.

BACKGROUND OF THE INVENTION

In order to use superconducting technologies to measure electrical waveforms produced by room temperature devices, or indeed to interface any low temperature electronic device to a room temperature electronic device, the interface mechanism must satisfy certain electrical, mechanical, and temperature constraints.

U.S. Pat. No. 4,498,046 ('046) describes an interface which includes a pass-through liquid-helium-tight vacuum seal consisting of a flange and two half-cylindrical fused quartz portions, unequal in length, which act as a pass-through plug from a liquid-helium filled cryostat to a vacuum chamber. The two fused quartz half-cylinder portions of the pass-through plug are arranged so that the longer portion, which has copper striplines patterned on its flat surface, extends sufficiently beyond its mating half-cylinder portion on both ends to provide two platforms at opposite ends of the plug. A low temperature semiconductor chip or device is mounted on one of these platforms and a room temperature chip or device is mounted on the other. In operation, the pass-through plug is inserted through the cryostat wall such that the low temperature chip is immersed in liquid helium in the cryostat and the room temperature chip is disposed, near a heating element, inside the vacuum chamber. This chamber must be evacuated in order to prevent frosting of water and other gases on the plug, and also to provide adequate insulation for the cryostat.

The U.S. Pat No. 4,498,046 has numerous problems which render it costly and impractical to use in commercial applications. The U.S. Pat. No. 4,498,046 apparatus is typical of similar devices developed in the field of low temperature electronics which utilize liquid helium for achieving the necessary cooling temperatures.

A second example of the prior art which has drawbacks is a product used in the field of optics to cool devices, known by the trademark Heli-Tran and made by Air Products and Chemicals, Allentown, Pa. The Heli-Tran comprises a vacuum enclosed mounting head for holding a sample to be cooled, and a multi-channel flexible transfer tube for connecting the mounting head to a dewar of liquid helium. The transfer tube is believed to comprise a forward helium flow capillary (from the dewar to the mounting head), a shield tube surrounding the forward helium flow capillary, and a separate return flow capillary for the shield fluid. When the dewar is pressurized, liquid helium flows through both the forward helium flow capillary and the shield tube into the mounting head. The helium in the capillary strikes the inside surface of a metal block closing off the end of the transfer tube, then enters a passage coaxially surrounding all the transfer tube elements, travels a short distance in the return direction, and exits through a helium exhaust port. The helium in the shield tube turns back before the metal block, enters the return flow capillary, and exits from a shield flow return port near the dewar. The sample holder is attached to the outside of the metal block, so that it can conduct heat from the sample to be cooled into the metal block, which is itself cooled by the helium in the forward flow capillary.

The primary drawbacks with the Heli-Tran system are that the mounting head is entirely enclosed in a vacuum shroud, rendering sample demounting difficult and cumbersome and that the literature teaches total immersion of the sample, e.g., a superconducting electronic circuit, contributing to inefficient liquid helium consumption. In U.S. Pat. No. 3,894,403, FIG. 5, such a system is shown cooling a liquid helium bath in which a superconducting magnet is totally immersed.

Co-pending patent application Ser. No. 796,842, filed on Nov. 11, 1985, which is related to the present invention, discusses the aforementioned constraints and attempts of the prior art to satisfy them. The invention described and claimed in the said co-pending patent application obviates many of the foregoing problems. The device described therein includes a cooling chamber which encloses part of a sample to be cooled and a transfer tube which directs a stream of a cooling fluid through the cooling chamber to impinge upon the sample therein. The cooling fluid contacts the part of the sample within the chamber before being exhausted directly to the open air. Thus, the cooling chamber is not required to be a vacuum chamber and the device limits the surface area immersed in the cooling fluid However, accurate alignment of the stream of cooling fluid to insure that it strikes the part of the sample to be cooled was time-consuming and increased the cost of manufacturing.

SUMMARY OF THE INVENTION

The present invention is an improvement of an open-cycle cooling apparatus in which a cooling chamber holding a device to be cooled is coupled with a cold fluid delivery system and, in which the cold fluid delivery system includes a delivery tube which directs a stream of cold fluid to strike the device and a return which vents the expended cold fluid from the cooling chamber, wherein the improvement comprises means for accurately aligning the stream of cold fluid from the cold fluid delivery tube with the device to be cooled held within the cooling chamber.

BRIEF DESCRIPTION OF THE DRAWINGS

For a better understanding of the invention, reference is made to the following description of exemplary embodiments thereof, and to the accompanying drawings, wherein.

DETAILED DESCRIPTION

Figure 1A:
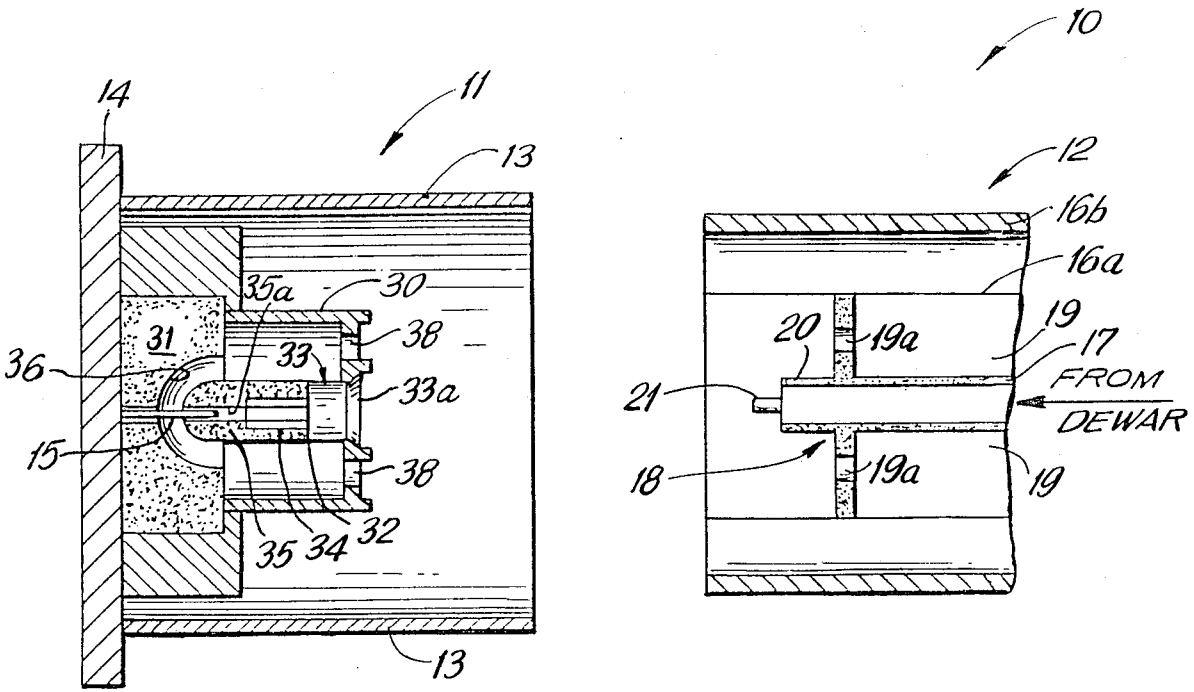
FIG. 1*a* is a schematic representation of a cut-away side view of a cooling apparatus of the present invention having a cooling chamber, with a device to be cooled situated therein, and a cold fluid transfer tube.
Figure 1B:
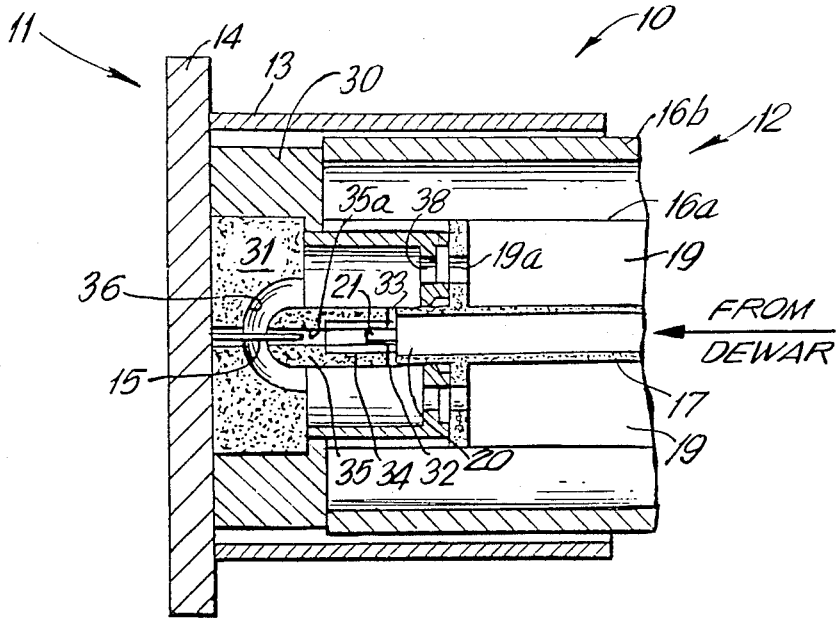
FIG. 1*b* is a schematic representation of a cut-away side view of the cooling apparatus of FIG. 1*a* having the cooling chamber and the cold fluid transfer tube in a coupled position.

FIGS. 1*a* and 1*b* are schematic representations of a cut-away side view of an apparatus 10 for cooling devices constructed according to the present invention.

The apparatus 10 comprises a cooling chamber 11 and a cold fluid transfer tube 12. In operation, the cold fluid transfer tube 12 is coupled to the cooling chamber 11 as shown in FIG. 1*b*. The cooling chamber 11 is formed by a rigid exterior frame 13 which is closed at one end of its length by a removable sample holder 14. A device 15 to be cooled, which can be, for example, an electronic circuit fabricated on a substrate, is mounted on the surface of the sample holder 14 lying within the chamber 11. The other end of the exterior frame 13 is open and sized to receive one end of the cold fluid transfer tube 12. The other end of the transfer tube 12 is connected to a dewar (not shown) of cold fluid, such as liquid helium.

The cold fluid transfer tube 12 is composed of two coaxial tubes, an inside delivery tube 16*a* for carrying the cold fluid and an outside tube 16*b* to provide insulation. The inside delivery tube 16*a* includes a central tube 17 which carries the cold fluid from the dewar to the free end 18 of the inside delivery tube 16*a* and a return channel 19 surrounding the central tube 17 which receives warmed fluid through an annular opening 19*a* at the free end 18 of the inside delivery tube 16*a*. As shown in FIG. 1*a*, the central tube 17 extends beyond the return channel 19 at the free end 18 of the inside delivery tube 16*a*. The free and extended end 20 of the central tube 17 can form a nozzle 21 which need not be of any particular shape, and may be merely the cut-off end of the tube.

The sample holder 14 is secured against the exterior frame 13 by being removably fastened to a rigid enclosure 30 formed within the cooling chamber 11 coaxially to the exterior frame 13. At the end fastened to the sample holder 14, the enclosure 30 surrounds the device 15 and, at the other end, the enclosure 30 is configured to adaptively couple with the free end 18 of the inside delivery tube 16*a* of the cold fluid transfer tube 12 as shown in FIG. 1*b*. The device 15 is disposed in a slit within an insulating material 31 formed within the enclosure 30 at the fastened end. The insulating material 31 is shaped to permit the portion of the device 15 that is desired to be cooled to protrude from the insulating material 31 toward the other end of the enclosure 30. The enclosure 30 thus defines a general pathway between the device 15 and the inside delivery tube 16*a* and also functions as an interlocking mechanism. Note that the exterior frame 13 and the enclosure 30 may be lined with an insulating material (not shown), such as teflon or styrofoam.

An alignment guide 32 is also disposed within the enclosure 30, between the device 15 and the end of the enclosure 30 that couples with the inside delivery tube 16*a*. As shown in FIG. 1*b*, the guide 32 is configured to adaptively receive and hold the free and extended end 20 of the central tube 17 and comprises three components: a receptacle 33, an input tube 34, and a cap 35 made of insulating material. The receptacle 33, which includes a frontal boss 33*a*, is the first component of the guide 32 that the central tube 17 engages and, as such, it is shaped and sized to receive the free and extended end 20 of the central tube 17 which fits loosely therein. The receptacle 33 is rotatably secured to the enclosure 30 at the frontal boss 33*a* to permit rotation through 360 degrees. The input tube 34 is connected at one end of its length to the end of the receptacle 33 opposite the boss 33*a* and is shaped and sized to receive the nozzle 21 of the central tube 17. The other end of the input tube 34 remains free and is positioned directly opposite the device 15 to be cooled. The insulating cap 35 surrounds both the input tube 34 and the portion of the device 15 that is desired to be cooled establishing a passageway 35*a* between the free end of the input tube 34 and the device 15. The insulating cap 35 does not contact the insulating material 31 so that a channel 36 is formed therebetween. The channel 36 leads to the remainder of the interior space of the enclosure 30 which is unfilled and which, in turn, leads to an annular opening 38 at the end of the enclosure 30 that couples with the inside delivery tube 16*a*. The annular opening 38 is sized and shaped equal to the annular opening 19*a* of the free end 18 of the inside delivery tube 16*a*.

As shown in FIG. 1*b*, in operation, the cooling chamber 11 and the cold fluid transfer tube 12 couple together so that the free end 18 of the inside delivery tube 16*a* fits loosely around the receiving end of the enclosure 30. In this coupled position, the annular opening 38 of the enclosure 30 aligns with the annular opening 19*a* of the inside delivery tube 16*a*. In addition, the free and extended end 20 of the central tube 17 engages the alignment guide 32 so that the nozzle 21 is inserted within the input tube 34 and the free and extended end 20 rests within the receptacle 33.

Upon the completion of the coupling stage, a control mechanism for the cooling apparatus 10 pressurizes the dewar forcing the cold fluid within the dewar to be carried through the central tube 17 and ejected from the nozzle 21. The cold fluid flows through the input tube 34 and the passageway 35*a* within the insulating cap 35 and strikes the portion of the device 15 that is desired to be cooled. The device 15 portion is thereby quickly cooled to cryogenic temperatures. The warmed fluid, then exits the passageway 35*a*, strikes the insulating material 31 across from the insulating cap 35 and, due to the shape of the insulating material 31, deflects into the open interior space of the enclosure 30 via the channel 36. The warmed fluid exits the enclosure 30 through the annular opening 38 and enters the return channel 19 of the transfer tube 12 through the annular opening 19*a* of the free end 18 of the inside delivery tube 16*a*. Once inside the return channel 19, the warmed fluid is carried back through the transfer tube 12 to be either discarded or recycled.

The advantages of the present invention are several. First, the enclosure 30 and the alignment guide 32 are configured to protect the device 15 from accidental breakage by surrounding the device 15 and preventing contact, for example, with the free end 18 of the transfer tube 12 which is in motion during the coupling stage. Second, the enclosure 30 and the alignment guide 32 guarantee that the transfer tube 12 and, in particular, the central tube 17, is accurately centered with the device 15 regardless of the angle of entry by the transfer tube 12, which can be of flexible construction, into the cooling chamber 11. Third, the rotational ability of the receptacle 33 permits the cooling chamber 11 to rotate relative to the transfer tube 12 and thus compensate for any twisting or angular motion by the transfer tube 12. In fact, the rotational ability of the receptacle 33 permits such rotational compensation even during the actual cooling operation without affecting the alignment of the central tube 17, and thus, the stream of cold fluid, with the device 15.

Figure 2:
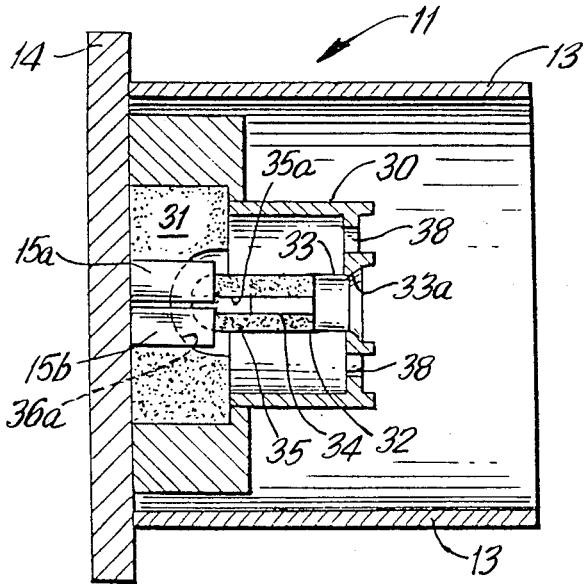
FIG. 2 is a schematic representation of a cut-away top view of the cooling chamber of FIG. 1.

Multiple devices may also be cooled by the present invention as shown in FIG. 2 which is a schematic representation of a cut-away top view of the cooling chamber 11 of the present invention. A device 15*a* and a device 15b are mounted on the sample holder 14 side by side and extend respective portions to be cooled within the passageway 35a of the insulating cap 35 so adapted. In operation, the stream of cold fluid from the transfer tube 12 strikes both devices 15a, 15b simultaneously which are thereby cooled to cryogenic temperatures. Similarly, a multiplicity of devices may be mounted on the sample holder 14, for example, in a radial fashion or in a stacked fashion, and each cooled at the same time with one stream of cold fluid. Such embodiments of the present invention realize the same advantages previously discussed and further increase the efficiency of cold fluid consumption by the cooling apparatus 10.

It is to be understood that the embodiments described herein are merely illustrative of the principles of the invention. Various modifications may be made thereto by persons skilled in the art without departing from the spirit and scope of the invention. For example, the exemplary embodiment accommodates a single nozzle 21; however, it should be clear that present invention can accommodate a plurality of nozzles from either a single transfer tube or several such tubes to cool a single device or a plurality of devices.

What is claimed is:

1. An improved open-cycle cooling apparatus in which a cooling chamber holding a device to be cooled is coupled with a cold fluid delivery system and, in which the cold fluid delivery system includes a delivery tube which directs a stream of cold fluid to strike the device and a return which vents the expended cold fluid from the cooling chamber, wherein the improvement comprises means for accurately aligning the stream of cold fluid from the cold fluid delivery tube with the device to be cooled held within the cooling chamber.

2. The improvement of claim 1, further comprising: return means for removing the expended cold fluid from the cooling chamber to the return of the cold fluid delivery system.

3. An improved open-cycle cooling apparatus in which a cooling chamber holding a device to be cooled is coupled with a cold fluid delivery system and, in which the cold fluid delivery system includes a delivery tube which directs a stream of cold fluid to strike the device and a return which vents the expended cold fluid from the cooling chamber, wherein the improvement comprises:

(a) means for adaptively engaging the cold fluid delivery tube with the cooling chamber;

(b) means for permitting rotation of the cooling chamber relative to the cold fluid delivery tube while said delivery tube is adaptively engaged to said chamber; and (c) means for accurately aligning the stream of cold fluid from the cold fluid delivery tube with the device to be cooled held within the cooling chamber.

4. The improvement of claim 3, further comprising: return means for removing the expended cold fluid from the cooling chamber to the return of the cold fluid delivery system.

5. An improved open-cycle cooling apparatus in which a cooling chamber holding a device to be cooled is coupled with a cold fluid delivery system and, in which the cold fluid delivery system includes a delivery tube which directs a stream of cold fluid to strike the device and a return which vents the expended cold fluid from the cooling chamber, wherein the improvement comprises:

a rigid enclosure formed within the cooling chamber and configured to adaptively engage one end of the cold fluid delivery tube, said device to be cooled disposed and held in place within the enclosure; and (b) a guide disposed within the enclosure between the device to be cooled and the one end of the cold fluid delivery tube adaptively engaged to the enclosure, said guide being configured to adaptively receive the one end of the cold fluid delivery tube and disposed to accurately align the stream of cold fluid from the cold fluid delivery tube with the device to be cooled held within the enclosure.

6. The improvement of claim 5, further comprising: return means for removing the expended cold fluid from the cooling chamber to the return of the cold fluid delivery system.

7. The improvement of claim 5, wherein the guide further comprises: means for permitting rotation of the cooling chamber and the enclosure relative to the cold fluid delivery tube while the one end of said delivery tube is adaptively engaged to said enclosure and is adaptively received by said guide.

8. The improvement of claim 5, wherein the guide further comprises: means for permitting rotation of the cooling chamber and the enclosure relative to the cold fluid delivery tube while the one end of said delivery tube is adaptively engaged to said enclosure and is adaptively received by said guide and wherein the rigid enclosure further comprises: return means for removing the expended cold fluid from the cooling chamber to the return of the cold fluid delivery system.

9. The improvement of claim 5, wherein the guide further comprises:

(a) a receptacle which is configured to adaptively receive the one end of the cold fluid delivery tube, said receptacle being rotatably secured to the enclosure so as to permit rotation of the cooling chamber and the enclosure relative to the one end of the cold fluid delivery tube while the one end of said delivery tube is adaptively received by said receptacle;

(b) an input tube, at one end of its length, connected to the receptacle and, at the other end, positioned directly opposite the device to be cooled, said tube forming a portion of a passageway between the cold fluid delivery tube and the device to be cooled; and (c) the insulating cap surrounding the input tube and the portion of the device desired to be cooled, said cap forming the remaining portion of the passageway between the cold fluid delivery tube and the device to be cooled.

10. The improvement of claim 5, wherein the guide further comprises:

(a) a receptacle which is configured to adaptively receive the one end of the cold fluid delivery tube, said receptacle being rotatably secured to the enclosure so as to permit rotation of the cooling chamber and the enclosure relative to the one end of the cold fluid delivery tube while the one end of said delivery tube is adaptively received by said receptacle;

(b) an input tube, at one end of its length, connected to the receptacle and, at the other end, positioned directly opposite the device to be cooled, said tube forming a portion of a passageway between the cold fluid delivery tube and the device to be cooled; and (c) an insulating cap surrounding the input tube and the portion of the device desired to be cooled, said cap forming the remaining portion of the passageway between the cold fluid delivery tube and the device to be cooled and the rigid enclosure further comprises: return means for removing the expended cold fluid from the cooling chamber to the return of the cold fluid delivery system.

* * * * *